US007374115B2

(12) United States Patent
Geiger et al.

(10) Patent No.: US 7,374,115 B2
(45) Date of Patent: May 20, 2008

(54) BALL MILL PROVIDED WITH AN AGITATOR

(75) Inventors: Armin Geiger, Bichwil (CH); Olaf Eichstaedt, Winterthur (CH); Elias Muedespacher, Oberuzwil (CH)

(73) Assignee: Buehler AG, Uzwil (CH)

( * ) Notice: Subject to any disclaimer, the term of this patent is extended or adjusted under 35 U.S.C. 154(b) by 72 days.

(21) Appl. No.: 10/525,613

(22) PCT Filed: Aug. 19, 2003

(86) PCT No.: PCT/CH03/00560

§ 371 (c)(1),
(2), (4) Date: Apr. 21, 2005

(87) PCT Pub. No.: WO2004/020098

PCT Pub. Date: Mar. 11, 2004

(65) Prior Publication Data

US 2005/0211808 A1 Sep. 29, 2005

(30) Foreign Application Priority Data

Aug. 28, 2002 (DE) ..... 102 40 231
Mar. 27, 2003 (DE) ..... 103 13 993

(51) Int. Cl.
*B02C 17/16* (2006.01)

(52) U.S. Cl. ..... 241/171; 241/172; 241/285.3

(58) Field of Classification Search ..... 241/285.3, 241/171, 172

See application file for complete search history.

(56) References Cited

U.S. PATENT DOCUMENTS 4,174,074 A * 11/1979 Geiger ..... 241/46.11
5,474,237 A 12/1995 Bishop et al.
5,590,841 A 1/1997 Stein et al.
5,624,080 A 4/1997 Stehr et al.
5,853,132 A * 12/1998 Tsuji ..... 241/172
6,021,969 A * 2/2000 Schmitt et al. ..... 241/171

FOREIGN PATENT DOCUMENTS

GB 1 277 715 6/1972
JP 2002-316061 10/2002

* cited by examiner

*Primary Examiner*—Mark Rosenbaum
(74) *Attorney, Agent, or Firm*—Jordan and Hamburg LLP

(57) ABSTRACT

A ball mill is provided with an agitator and comprises a grinding chamber containing grinding medium, a stator and a rotor which are arranged in said grinding chamber, an input opening for material to be ground and an output opening for ground material which are used for bringing the material to be ground to the grinding chamber and for evacuating the ground material therefrom. The mill also comprises a device for separating the grinding medium arranged in the grinding chamber above the output opening. The rotor is embodied in the form of a rotational symmetry body, and the stator is formed by an internal surface which is complementary to the grinding chamber. The inventive rotor and the stator are provided with pins which are distributed through all surface thereof and projected to the grinding chamber.

18 Claims, 6 Drawing Sheets

BALL MILL PROVIDED WITH AN AGITATOR

BACKGROUND OF THE INVENTION

The invention relates to an agitating ball mill according to the preamble of claim 1.

Such agitating ball mills have a grinding chamber containing grinding media, a stator and a rotor, which are arranged in the grinding chamber, an input opening and an output opening for feeding and removing grinding material to or from the grinding chamber, as well as a grinding medium separation device arranged in the grinding chamber upstream from the output opening, which is used to separate grinding media entrained in the grinding material from the grinding material before the latter is removed from the grinding space through the output opening.

Agitating ball mills are used in the area of foodstuffs and in the manufacture of fine particles down to the nanometer range in size. Particles or agglomerates suspended in a liquid are here conveyed into the grinding chamber, and comminuted or dispersed in the grinding chamber by means of auxiliary grinding media before being conveyed out of the grinding chamber. To prevent the auxiliary grinding media from becoming dragged out of the agitating ball mill by the liquid stream of grinding material during this wet grinding process, resulting in the loss of the agitating ball mill and contamination of the grinding material, the auxiliary grinding media are held back in the grinding chamber by a separation device. A separating gap, grading screen or cellular wheel are used as separation devices. Essentially spherical elements made out of steel, glass, ceramic or plastic are used as the auxiliary grinding media.

In order to increase the mechanical grinding power introduced into the grinding material in the grinding chamber, the rotor and/or stator of known agitating ball mills is provided with pins that extend into the grinding chamber. As a result, impacts between the grinding material and the pins during operation directly contribute to the grinding power on the one hand. On the other hand, an indirect contribution to grinding power is made by impacts between the pins and the (auxiliary) grinding media entrained in the grinding material and subsequent impacts between the grinding material and grinding media. Finally, the shear and expansion forces acting on the grinding material also help comminute the suspended grinding material particles.

SUMMARY OF THE INVENTION

The object of the invention is to achieve an enhanced grinding effect relative to known agitating ball mils at a prescribed rotor/stator geometry or grinding chamber geometry and at a prescribed rotor speed.

The fact that the rotor is essentially shaped like a rotationally symmetric element and the stator is formed by an essentially complementary inner surface of the grinding chamber enables a high power density for the mechanical introduction of energy into the grinding material as well as the greatest possible ratio between the processing area space and processing area volume, and hence an optimal cooling of the grinding material during wet grinding or comminuting.

The fact that the rotor and stator have pins distributed over their entire respective surface, extending from the respective surface and projecting into the processing space enables the direct and indirect action of the pins distributed over the entire grinding chamber volume, i.e., the impacts between the grinding material and pins, the impacts between the pins and the grinding media entrained in the grinding material, as well as the shearing and expansion forces triggered by the pins in the suspension consisting of grinding material and grinding media, which together help comminute the suspended grinding material particles.

As a whole, then, improved grinding power is achieved, accompanied simultaneously by an evening out of grinding intensity, and hence also of an unnecessary strain on the grinding material, e.g., as the result of local overheating, in the entire grinding chamber.

It is particularly advantageous for the grinding material input opening to be arranged in a radially outer area of the grinding chamber, and the grinding material output opening to be arranged in a radially inner area of the grinding chamber. During operation, an equilibrium essentially sets in at on the auxiliary grinding media between a radially outwardly directed centrifugal force component due to the rotation of the rotor around its rotational axis and a radially inwardly directed drag force component due to the grinding material flowing radially from the outside in. The flow of grinding material is maintained by a separate pump, for example. This exposure to centrifugal force provides a "dynamic" relief for the separation device situated radially inside the grinding material output opening, i.e., most of the auxiliary grinding media is suspended, more or less stationary, in the radially outer areas of the processing area, and forms a "swarm" of auxiliary grinding media through which the grinding material is pumped. The few auxiliary grinding media that get into the radially inner area of the processing area in the process are then caught by the separation device. As a result, the separation device is protected and subjected to less wear.

The rotor can essentially be shaped like a truncated cone, wherein the grinding material input opening is arranged in the area of the wide truncated cone end, and the grinding material output opening is arranged in the area of the narrow truncated cone end of the grinding chamber. As an alternative, the rotor can also essentially be shaped like a double truncated cone. In both cases, the grinding material is preferably pumped radially from the outside radially inward.

As a further alternative, the rotor can essentially be shaped like a cylinder, wherein the grinding material input opening is arranged in the area of the first cylinder end, and the grinding material output opening is arranged in the area of the second cylinder end of the grinding chamber, and the grinding material is essentially spirally transported along the cylinder jacket of the rotor through the processing area.

In another advantageous embodiment, the rotor is essentially shaped like a disk, wherein the grinding material input opening is arranged in the radially outer peripheral area, and the grinding material output opening is arranged in the radially inner axial area of the grinding chamber, so that the grinding material again flows through the processing area from the outside in. Here as well, the aforementioned equilibrium between a centrifugal force component and drag force component is also established at the auxiliary grinding media during operation. The grinding material pumped from outside in then once again provides the "dynamic" relief for the radially inner separation device.

It is particularly advantageous for the disk-shaped rotor to have pins on both its two flat disk surfaces and not its peripheral surface. The radially most outwardly lying pins are the fastest of all pins during operation. Since most of the auxiliary grinding media are radially suspended outside, a significant portion of the grinding effect is exerted in just this peripheral area of the processing area alone, resulting in a clearly increase in grinding power at the disk edge by comparison to an agitating ball mill without pins.

The grinding chamber with its stator and rotor and the separation device can preferably be pivoted into a swiveled position in such a way that the separation device arrives at a high location, which is preferably higher than most of the entire grinding chamber volume. This makes it possible to remove the separation device without evacuating the auxiliary grinding medium or product, since the auxiliary grinding medium swell does not reach the height of the separation device in the swiveled position. In addition, this allows the use in the agitating ball mill of a rotatable separation device with spoke or leaf-like elements, e.g., a spoke wheel, paddle wheel or cellular wheel, wherein the separating effect of the separation device only comes about when it starts to rotate. Because the processing zone can swivel according to the invention, the separation device can be made operational in this case, as long as the processing zone is tilted, and the separation device is situated at the high location. After activation, the processing zone is then tilted to the operational setting, in which the auxiliary grinding media now arrive at the separation device, which now exerts a separating action.

Once between 50% and 100% of the entire grinding chamber volume lies under the separation device in the swiveled position, depending on the grinding medium quantity in the agitating ball mill, no auxiliary grinding media will be able to fall out of the grinding chamber owing to the use of a "rotatable" separation device that is inactive when idle, or the lack of a dismantled separation device.

The swiveled, high location of the separation device is best the highest location of the agitating ball mill achievable via swiveling. This facilitates access to the separation device. In addition, auxiliary grinding media located in or on the separation device can be poured out or stripped into the grinding chamber without any problem via the opening to the grinding chamber during the dismantling of the separation device.

The swiveling position is best a non-operating position of the agitating ball mill. In the operating position of the agitating ball mill, the rotational axis of the rotor is essentially arranged horizontally.

The separation device is preferably exchangeable. For example, it can be a self-cleaning grading screen or a paddle wheel.

In another advantageous embodiment, the rotor is a hollow rotor with holes arranged radially inside the rotor, and holes arranged radially outside the rotor. During operation, the auxiliary grinding media are here transported along with a portion of the grinding material flow inside the rotor from a radially inner hole to one of the radially outer holes via the centrifugal action of the rotor, and transported outside the rotor with the entire grinding material flow from the radially outer hole to the radially inner hole via the pumping action of the grinding material input opening, so that the auxiliary grinding media circulate inside the agitating ball mill.

The radially inner hole preferably extends in the circumferential direction given an inner radius Ri at the rotor, and the radially outer hole preferably extends in the circumferential direction given an outer radius Ra at the rotor. This facilitates the entry of auxiliary grinding media along with a portion of the grinding material flow into the rotor cavity, as well as the exit of auxiliary grinding media along with this portion of grinding material flow out of the rotor cavity.

In a particularly preferred embodiment, the hollow rotor exhibits inner channels, which each form a fluid connection between a radially inner hole and a radially outer hole. These spoke-like channels arranged inside the rotor exert a strong centrifugal force on the auxiliary grinding media, so that the latter are transported back out efficiently.

Other advantages, features and possible applications of the invention may be gleaned form the description of an exemplary embodiments based on the drawings, which are not to be construed as limiting.

DESCRIPTION OF THE PREFERRED EMBODIMENTS

Figure 1:
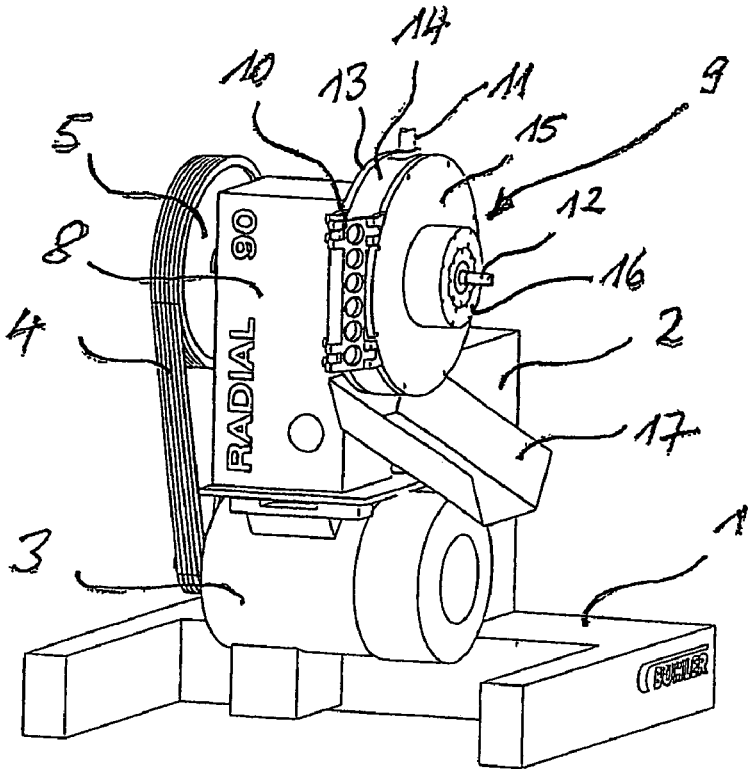
FIG. 1 is a perspective view of an agitating ball mill according to one embodiment of the invention in an operating position.

FIG. 1 shows an agitating ball mill according to the invention in its operating position with horizontal rotor rotational axis. The agitating ball mill is secured to a vertical element 2, which is connected with an engine bracket 1. A motor 3 uses a belt transmission 4 to drive a pulley 5, which is secured with the rotor 21 (see FIG. 5) of the agitating ball mill so that it cannot rotate via a shaft situated in a bearing 6 arranged under a cladding 8 (see FIG. 4). The rotationally driven rotor 21 rotates in the grinding chamber 9. The grinding material to be ground passes through a grinding material input opening 11 arranged radially outside and radially on the grinding chamber 9 and into the grinding chamber 9, and exits the grinding chamber 9 via a grinding material output opening 12 arranged radially inside and axially on the grinding chamber. The grinding chamber essentially consists of three parts, specifically a first, flat grinding chamber wall 13, a curved grinding chamber wall 14 on the grinding chamber periphery, and a second flat grinding chamber wall 15. The curved grinding chamber wall 14 and the second flat grinding chamber wall 15 are rigidly connected with each other to form a single unit. This unit 14, 15 is coupled to the first flat grinding chamber wall 13 by means of a hinge 10. In addition, a cylindrical screen jacket 16 is rigidly connected with the second flat grinding chamber wall 15, and arranged centrally on the grinding chamber wall 15, projecting axially to the outside. Located inside this screen jacket 16 is a separation device 18 in the form of a cylindrical grading screen (see FIG. 3). The grinding material output opening 12 is formed by an axially running pipe, which ends inside the cylindrical grading screen 18. Situated outside the output opening 12 is an inclined, downwardly running groove 17, with which grinding material and grinding media can be discharged from the processing zone in a controlled fashion.

Figure 2:
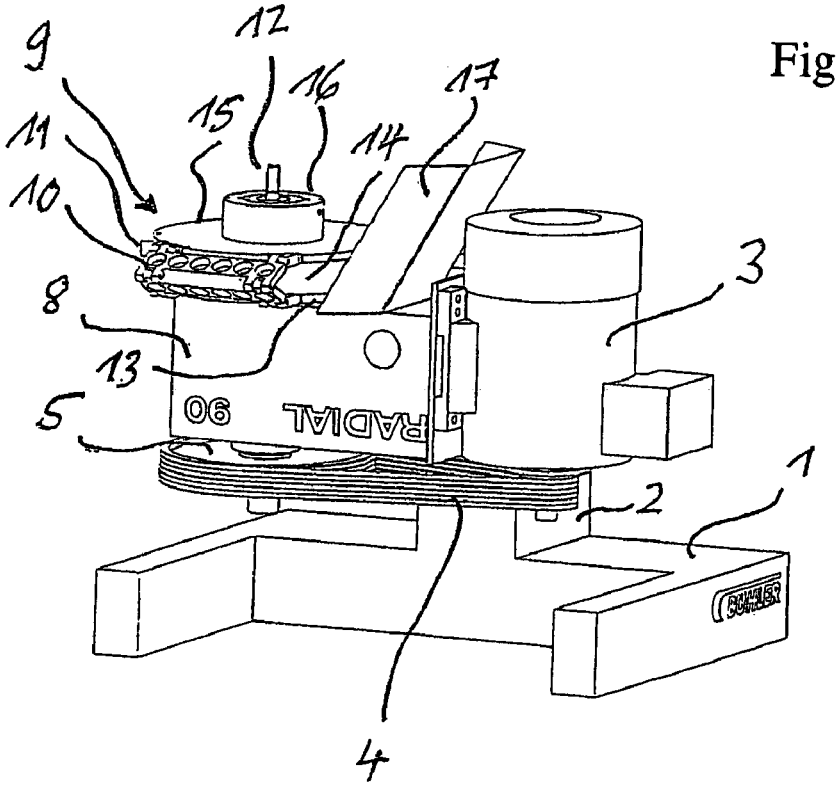
FIG. 2 is a perspective view of the agitating ball mill on FIG. 1 in a tilted, non-operating position or maintenance position.

FIG. 2 shows the agitating ball mill according to the invention on FIG. 1 with a vertical rotational axis of the rotor in the tilted position. The reference numbers and elements corresponding thereto are the same as on FIG. 1. As evident, all function elements 3 to 17 of the agitating ball mill on FIG. 2 are tilted by 90° around a horizontal swiveling axis. Only the engine bracket 1 and vertical element 2 are in the same position as on FIG. 1. In this tilted position, the screen jacket 16 is more readily accessible, so that, during maintenance, the grading screen 18 (see FIG. 3) can be more easily dismantled and installed. In addition, auxiliary grinding media (not shown) adhering to the grading screen or jammed therein can be easily stripped or shaken into the grinding chamber 9.

Figure 3:
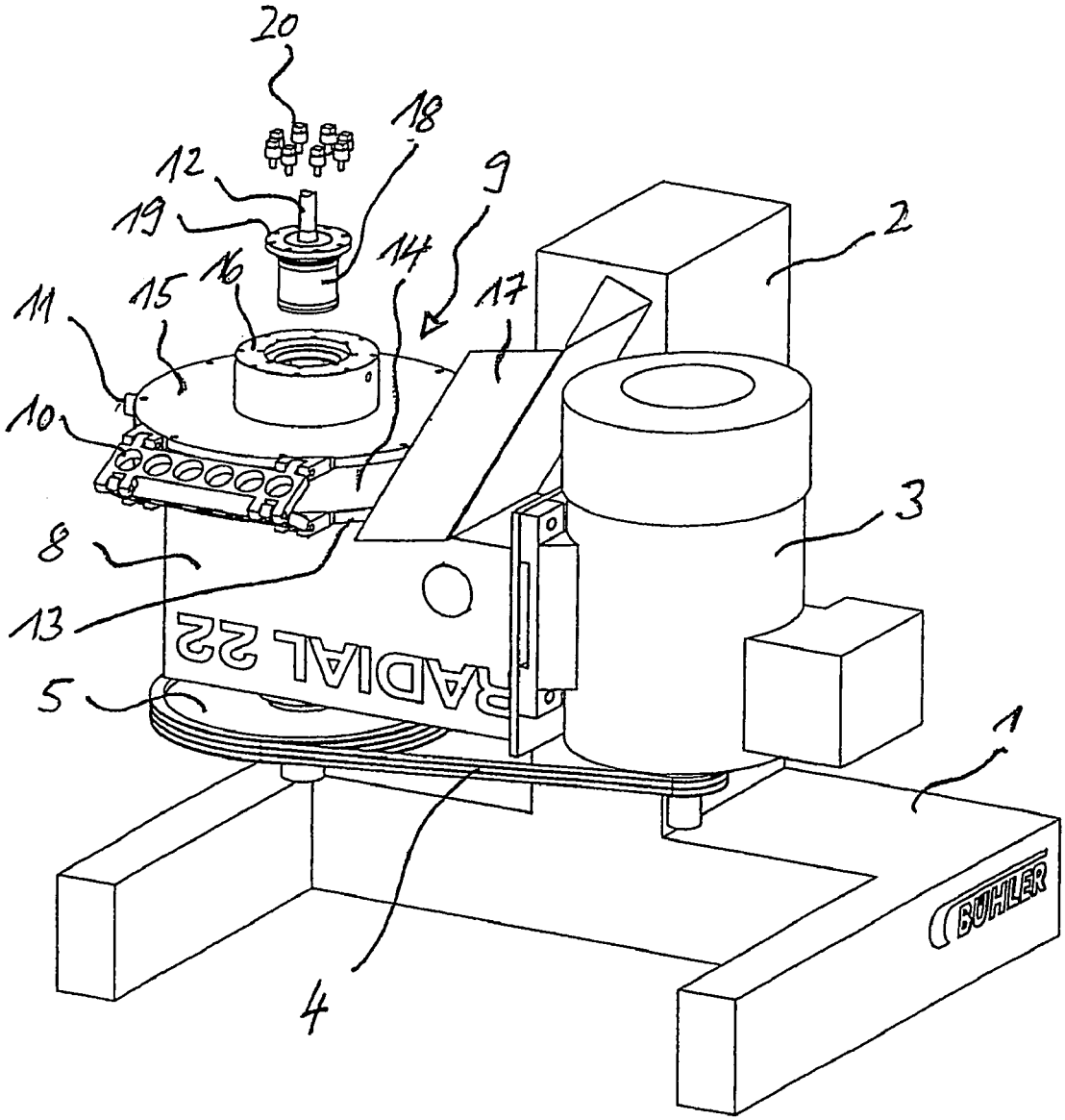
FIG. 3 is a magnified perspective view similar to that of FIG. 2 of the agitating ball mill according to the invention with dismantled separation device.

FIG. 3 shows the tilted agitating ball mill according to the invention as on FIG. 2, but magnified somewhat. The reference numbers and elements corresponding thereto are the same as on FIG. 1 and FIG. 2. In addition, the grading screen 18 is shown in the dismantled state. As best illustrated by FIG. 3, the upper cylinder edge of the cylindrical grading screen 18 has a flange 19 with holes, which is used to secure the grading screen 18 to the screen jacket 16 with screws 20 during reinstallation. The grading screen 18 could not be dismantled and installed in the operating position with horizontal rotational axis of the rotor (see FIG. 1) without any preparatory work. The grinding space content and in particular the grinding media would have to be discharged first.

In addition, the tiltability of the agitating ball mill according to the invention makes it possible to use a separation device other than the "passive" grading screen, e.g., a cellular wheel or a paddle wheel, which can only separate out auxiliary grinding media when operational, i.e., during rotation. If the goal is to stop an agitating ball mill equipped with such an, "active" separation device, it can be tilted in the vertical position with a vertical rotational axis beforehand. The reverse process is followed during renewed startup. The rotor and "active" separation device are first made to rotate with a vertical rotational axis while the agitating ball mill is still tilted, so that the separating action of the "active" separation device is restored, whereupon the agitating ball mill is tilted back into the horizontal operating position with a horizontal rotational axis.

Figure 4:
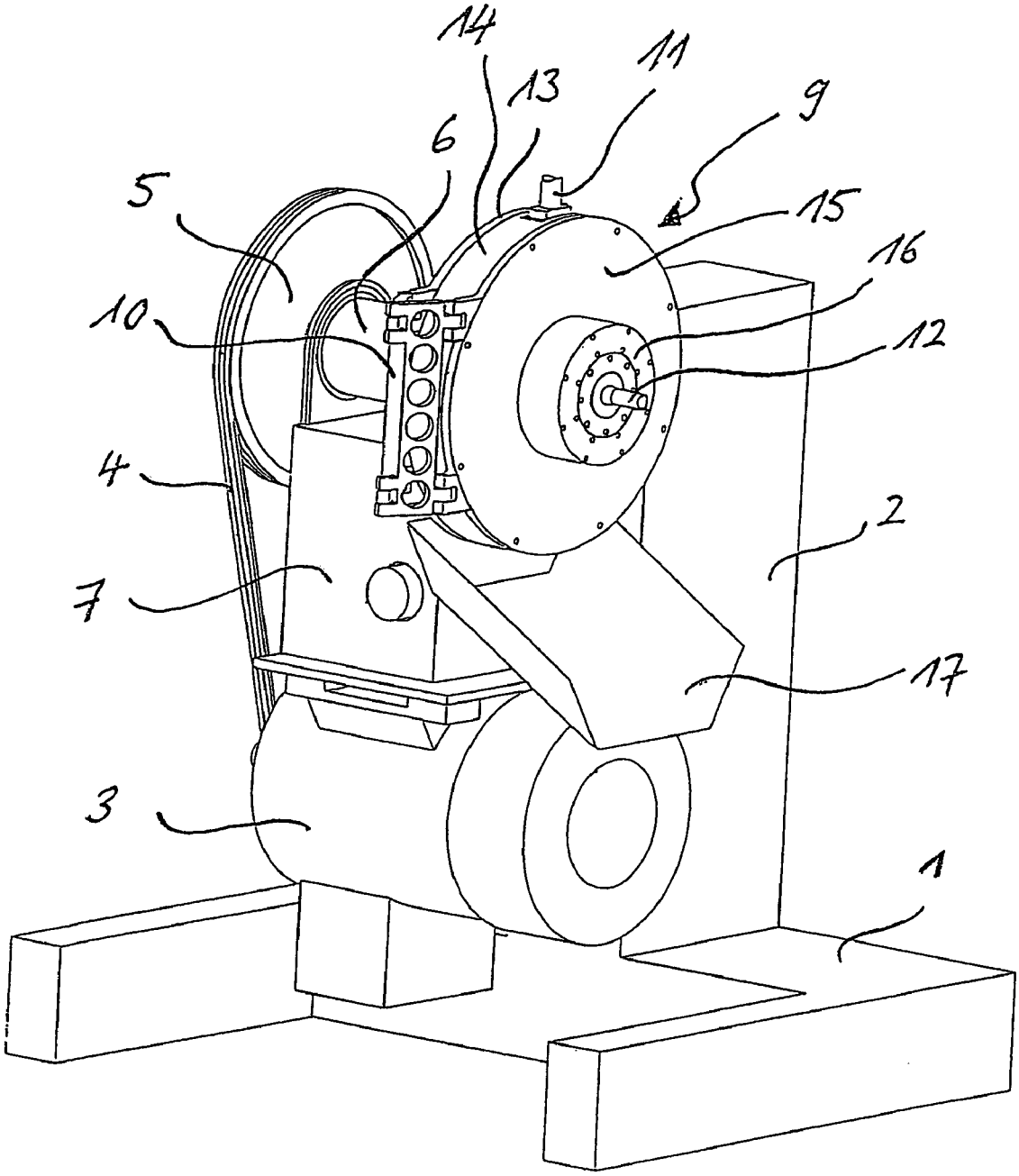
FIG. 4 is a perspective view similar to that of FIG. 1 of the agitating ball mill according to the invention.

FIG. 4 shows the agitating ball mill according to the invention magnified somewhat by comparison to FIG. 1. The reference numbers and elements corresponding thereto are the same as on FIG. 1, FIG. 2 and FIG. 3. As opposed to FIG. 1, the cladding 8 was here omitted, revealing the bearing 6 for the drive shaft and carrier 7 of the pivoting engine part.

Figure 5:
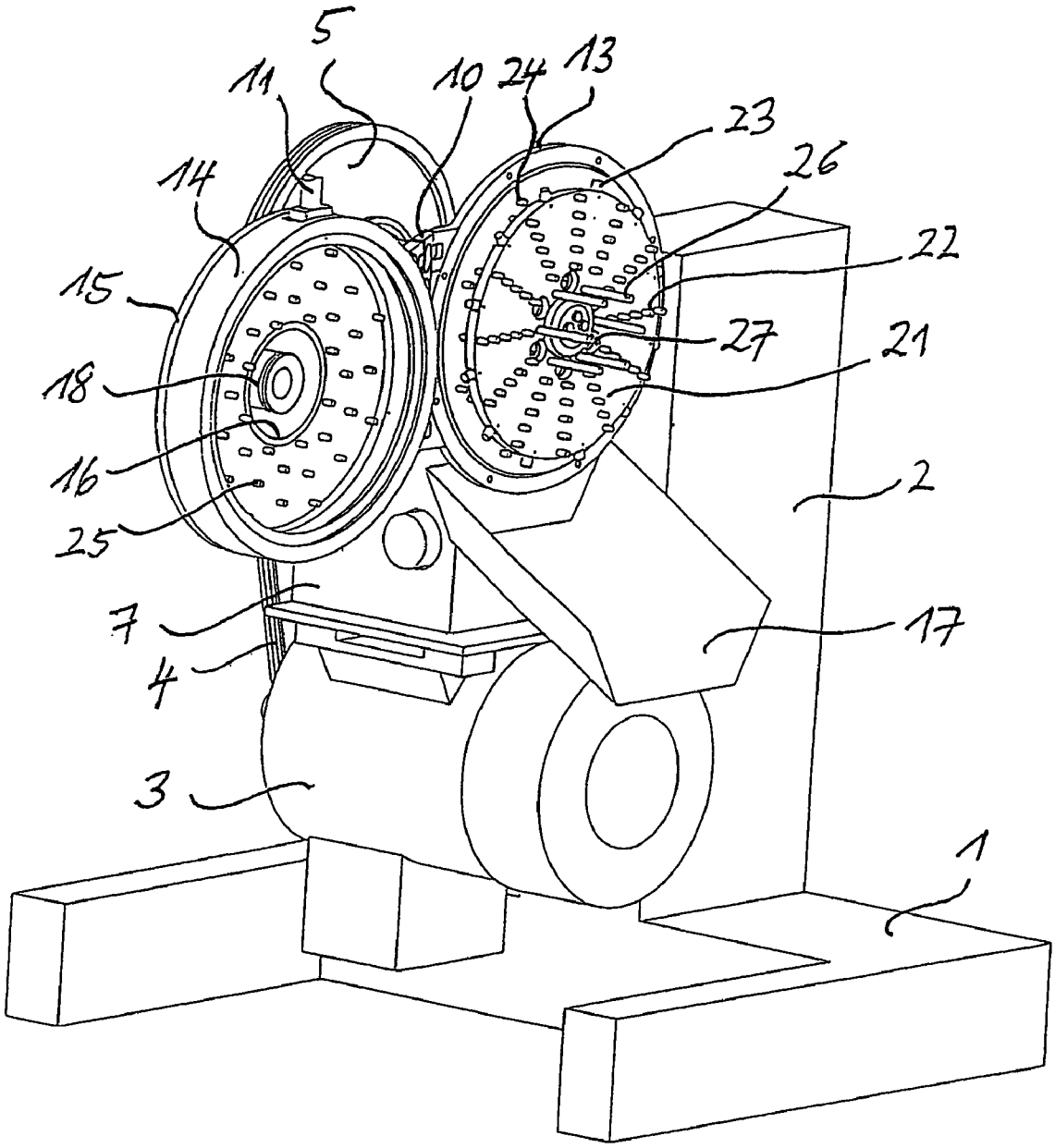
FIG. 5 is a perspective view of the agitating ball mill on FIG. 4 with open processing zone.

FIG. 5 shows the agitating ball mill on FIG. 4 with opened processing zone, i.e., in a state where the grinding chamber 9 is opened. The grinding chamber 9 was opened by swiveling the unit 14, 15, 16 comprised of the second flat grinding chamber wall 15, the curved grinding chamber wall 14 and the screen jacket 16 and coupled to the first flat grinding chamber wall 13 via the hinge 10 away from the grinding chamber wall 13. Visible here is the disk-shaped rotor 21 screwed to the drive shaft so that it cannot rotate, whose flat surface areas are equipped with pins 22, and whose curved edge areas are equipped with additional pins 23 along the circumferential direction. Corresponding pins opposing the pins 22 and radially shifted relative thereto are also arranged on the stator surfaces, i.e., on the side of the grinding chamber walls 13 and 15 facing into the processing space. The grading screen 18 concentrically arranged inside the screen jacket 16 can be discerned in the middle of the swiveled-away unit 14, 15, 16. One characteristic feature involves the pins 26, which are also arranged on the rotor disk 21, but only on their side facing the grinding chamber wall 15, thereby generating a cleansing turbulence around a static separation device. These screen cleaning pins, whose length corresponds roughly to the cylinder length of the grading screen, are arranged approximately concentrically around the midpoint of rotor disk 21, and extend parallel to both each other and the rotational axis of the rotor, thereby extending into the gap between the grading screen 18 and screen jacket 16 when closing the grinding chamber, i.e., swiveling back the unit 14, 15, 16. All elements of the grinding chamber wall, i.e., the first flat grinding chamber wall 13, the curved grinding chamber wall 14, and the second flat grinding chamber wall 15, along with the screen jacket 16, have cooling channels (not shown). The rotor disk 21 incorporates holes 27 that unite both processing space halves, and are located in proximity to the connecting points between the screen cleaning pins 26 and rotor disk 21, concentrically around the midpoint of the rotor disk 21.

During operation, the product to be ground (e.g., suspension with particles to be comminuted) is pumped via the input opening 11 into the grinding chamber 9, in which the driven rotor disk 21 rotates. The interaction between the grinding media (not shown) and the pins 22, 23 on the rotor disk 21, as well as the pins 24, 25 on the stator, comminutes the particles suspended in the product. The product comminuted and dispersed in this way as it passes through the processing space from the outside in finally arrives at the gap between the grading screen 18 and screen jacket 16, and passes through the grading screen 18 toward the output opening 12. If, despite the high centrifugal field in the grinding chamber 9 and its higher density relative to the grinding material, several grinding media get as far as the grading screen owing to "unfortunate" impacts and/or entrainment by the grinding material flow, they are retained there at the latest. The screen cleaning pins 26 circulating relative to the resting grading screen 18 on its surface with the rotor speed ensure that the grinding material is vigorously swirled with velocity components tangential to the surface of the grading screen. This keeps the grading screen largely free of deposits and conglutinations. In addition, strays are prevented from accumulating among the auxiliary grinding media in the grading screen and quickly jamming the grading screen together with the grinding material.

Figure 6:
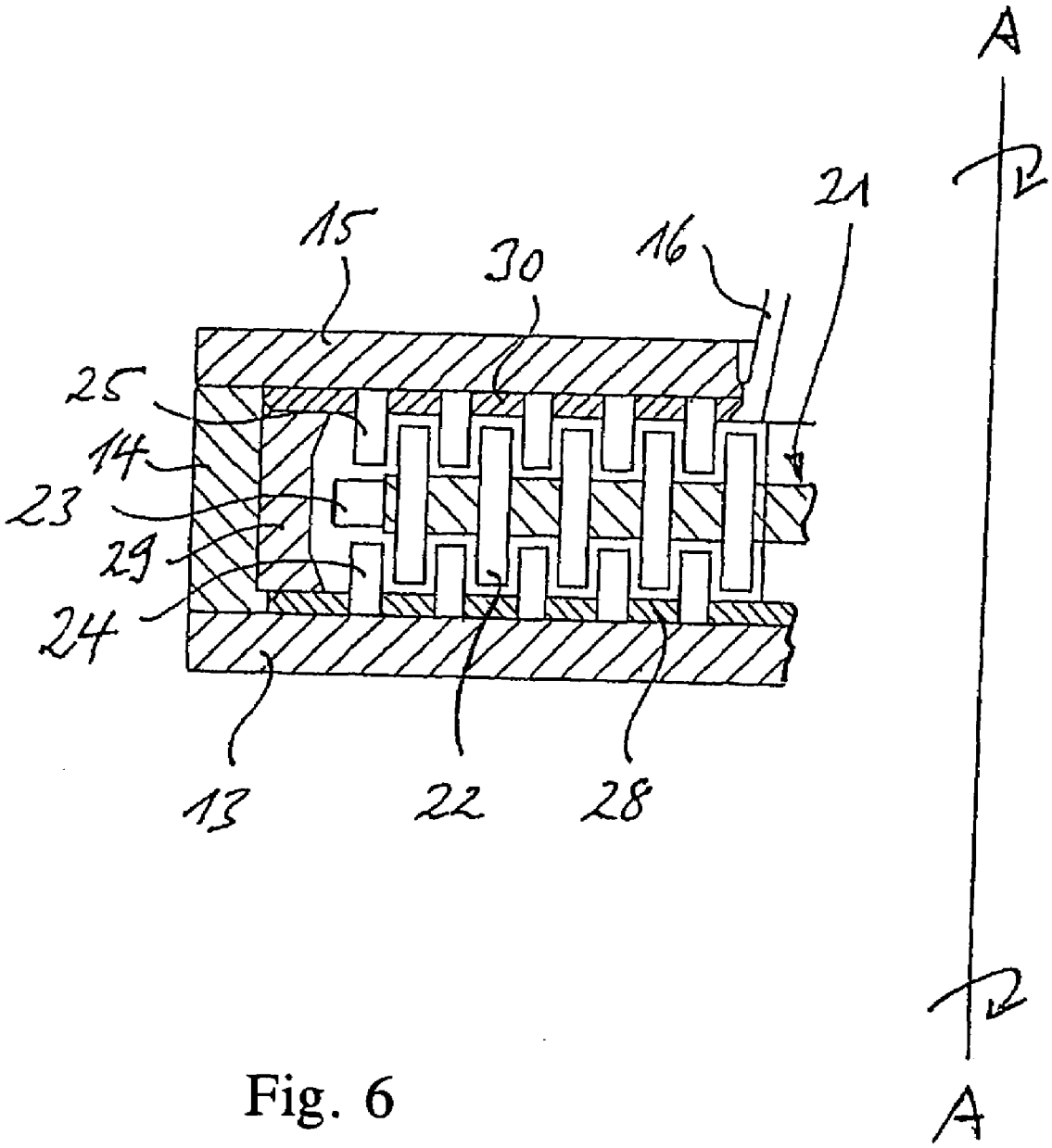
FIG. 6 is a sectional view of half of an agitator of a respective exemplary embodiment of the agitating ball mill according to the invention, wherein the cutting plane is selected in such a way as to encompass the rotational axis A-A of the agitator.

FIG. 6 shows a side view of half an agitator of a respective exemplary embodiment of the agitating ball mill according to the invention, wherein the cutting plane is selected in such a way that the rotational axis A-A of the agitator lies therein. The radially inner area of the agitator near the axis was cut away, since its design is largely independent for the agitator shown on the figure.

The disk-shaped rotor marked 21 overall is interspersed by axially parallel pins 22, which are fitted, screwed or otherwise secured in axially parallel boreholes of the rotor disk 21, and project into the grinding chamber from the rotor disk 21 on either of its sides. In addition, pins 23 extending radially out are spaced apart from each other in a circumferential direction on the outer edge of the rotor disk 21. The stator or grinding space casing is formed by the first flat grinding chamber wall 13, the curved grinding chamber wall 14 as well as the second grinding chamber wall 15 (compare FIG. 5). The two flat grinding chamber walls 13 and 15 have pins 24 and 25 extending into the grinding space, which are offset relative to the pins 22 of the rotor disk 21. The radial pins arranged on the outer edge of the rotor disk 21 contribute significantly to the overall grinding capacity, since both these pins 23 as well as the grinding material exhibit particularly high speeds in this radially outermost area, so that a great deal of energy is expended there between the pins 23 and the grinding material or the auxiliary grinding media. The mentioned grinding chamber walls 13, 14 and 15 have claddings 28, 29 and 30 on the grinding space side, which consist of a non-abrasive material. Also subjected to a high level of wear, pins 22, 23, 24 and 25 can ideally be replaced. The side of the flat grinding chamber wall 15 facing the rotational axis A-A has the only partially shown screen jacket 16, which covers the grading screen 18 (compare FIG. 5).

Figure 7:
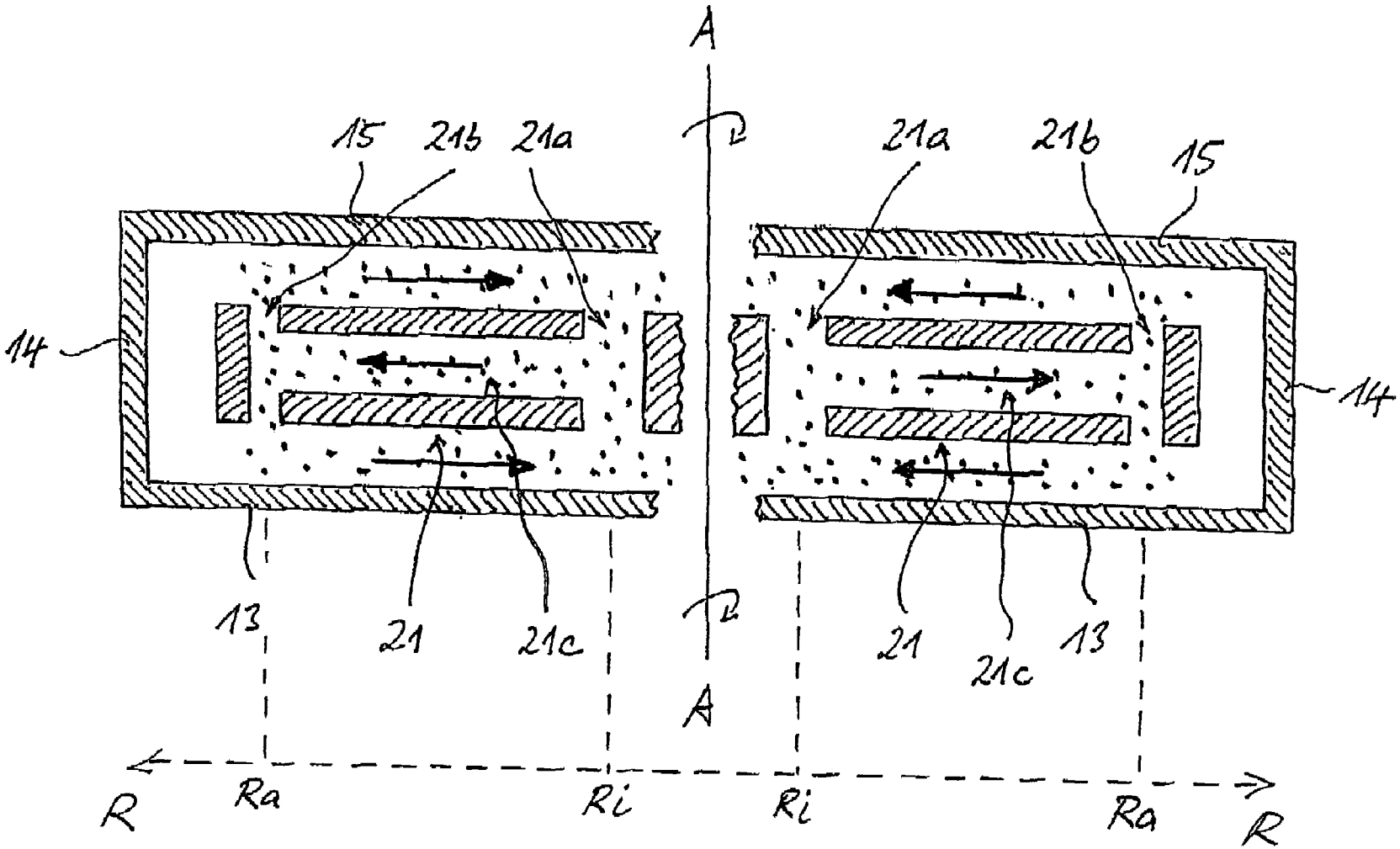
FIG. 7 is a sectional view of a diagrammatically depicted agitator, whose rotor has inner channels and enables grinding medium circulation.

FIG. 7 shows a sectional view of a diagrammatically depicted agitator, whose rotor has inner channels, and enables a grinding medium circulation along the sketched-in arrow. To ensure clarity, the pins 22, 23, 24 and 25 according to the invention shown in FIG. 6 were omitted from FIG. 7. The rotor marked 21 overall has at least one radially inner hole 21*a* at a radial distance Ri from the rotational axis A-a, and at least one radially outer hole 21*b* at a radial distance Ra from the rotational axis A-A. A flow channel is formed between these holes 21*a* and 21*b* via channels 21*c* inside the rotor 21. The stator is formed by the grinding chamber walls 13, 14 and 15 (compare FIG. 5). During operation, both drag and inertia forces act on the grinding media distributed in the grinding material (shown as black dots). In the grinding space area between the rotor 21 and the grinding chamber walls 13 and 15 forming the start, the grinding media are dragged toward the inside along the grinding material pumped into the grinding space radially from outside through the grinding material input opening 11 (compare FIG. 1, FIG. 5) via the channels formed by 13 and 21 or 13 and 15, since the drag forces of the grinding material flow directed radially inward on the grinding media are greater than the centrifugal forces of the grinding media directed radially outward on their curved paths. Correlations during operation are exactly opposite in the channels ("centrifugal channels") 21*c* and the rotor 21. The drag forces directed outwardly by the grinding material centrifuged radially outward act on the grinding media in conjunction with the also outwardly directed centrifugal forces, so that these are dragged radially outward. As a result, grinding media that always get into the radially inner area of the grinding space are again conveyed out. This prevents grinding media from accumulating on the radially inner separation device (not shown), thereby preventing an obstruction of the separation device, excessive wear of the grinding space, and an overheating of the grinding material in the radially inner area of the grinding space.

REFERENCE LIST

1 Engine bracket
2 Vertical element
3 Motor
4 Belt transmission
5 Pulley
6 Drive shaft bearing
7 Pivoting engine part carrier
8 Cladding
9 Grinding chamber
10 Hinge
11 Grinding material input opening
12 Grinding material output opening
13 First flat grinding chamber wall
14 Curved grinding chamber wall on grinding chamber periphery
15 Second flat grinding chamber wall
16 Screen jacket
17 Groove
18 Separation device, grading screen
19 Flange
20 Screws
21 Rotor, disk
21*a* Radially inner hole
21*b* Radially outer hole
21*c* Channels
22 Pin on disk plane
23 Pin on disk edge
24 Pin on stator
25 Pin on stator
26 Screen cleaning pin
27 Connecting holes
28 Cladding
29 Cladding
30 Cladding

The invention claimed is:

1. An agitating ball mill, comprising:

a grinding chamber containing grinding media;

a stator and a rotor which are arranged in the grinding chamber, said rotor being essentially shaped as a disk, said stator being formed by an inner surface of the grinding chamber, said inner surface presenting a shape which essentially compliments the rotor surface, the rotor and the stator each having pins arranged over an entire respective surface thereof which extend from the respective surface and project into the processing space;

structure defining a grinding material input opening and a grinding material output opening for feeding and removing grinding material to or from the grinding chamber, the grinding material input opening being arranged in a radially outer peripheral area of the grinding chamber, and the grinding material output opening being arranged in a radially inner area of the grinding chamber; and a grinding medium separation device, arranged in the grinding chamber upstream from the output opening, used to separate grinding media entrained in the grinding material from the grinding material before the grinding material is removed from the grinding space through the output opening.

2. The agitating ball mill according to claim 1, wherein the disk has pins on both of two flat disk surfaces thereof.

3. The agitating ball mill according to claim 1, wherein the grinding chamber with said stator, said rotor and said separation device is pivotable into a swiveled position in such a way that the separation device arrives at an elevated location which is higher than most of the entire grinding chamber volume.

4. The agitating ball mill according to claim 3, wherein the swiveled position is a non-operating position of the agitating ball mill.

5. The agitating ball mill according to claim 3, wherein a rotational axis of the rotor is essentially arranged horizontal in the operating position of the agitating ball mill.

6. The agitating ball mill according to claim 3, wherein a rotational axis of the rotor is essentially arranged vertical in the non-operating position.

7. The agitating ball mill according to claim 3, wherein most of the grinding chamber volume takes up between 50% and 100% of the entire grinding chamber volume.

8. The agitating ball mill according to claim 3, wherein said elevated location of the separation device is the highest location of the separation device achievable via swiveling.

9. The agitating ball mill according to claim 3, wherein the separation device is replaceable.

10. The agitating ball mill according to claim 3, wherein the separation device is a self-cleaning grading screen.

11. The agitating ball mill according to claim 3, wherein the separation device is a paddle wheel.

12. The agitating ball mill according to claim 3, wherein the separation device is a separating gap.

13. An agitating ball mill, comprising:

a grinding chamber containing grinding media;

a stator and a rotor which are arranged in the grinding chamber, said rotor being shaped as a rotationally symmetrical element, and said stator being formed by an inner surface of the grinding chamber, said inner surface presenting a shape which essentially compliments the rotor surface, the rotor and the stator each having pins arranged over an entire respective surface thereof which extend from the respective surface and project into the processing space, the rotor being a hollow rotor with at least one hole arranged radially inside the rotor and at least one hole arranged radially outside the rotor, wherein, during operation, the grinding media are transported along with a portion of the grinding material flow inside the rotor from the at least one radially inner hole to the at least one radially outer hole via centrifugal action of the rotor, and transported outside the rotor with an entire grinding material flow from the at least one radially outer hole to the at least one radially inner hole via pumping action of the grinding material input opening, so that the grinding media circulate inside the agitating ball mill;

structure defining a grinding material input opening and a grinding material output opening for feeding and removing grinding material to or from the grinding chamber, the grinding material input opening being arranged in a radially outer area of the grinding chamber, and the grinding material output opening being arranged in a radially inner area of the grinding chamber; and a grinding medium separation device, arranged in the grinding chamber upstream from the output opening, used to separate grinding media entrained in the grinding material from the grinding material before the grinding material is removed from the grinding space through the output opening.

14. The agitating ball mill according to claim 13, wherein the at least one radially inner hole extends in the circumferential direction given an inner radius Ri at the rotor, and the at least one radially outer hole extends in a circumferential direction given an outer radius Ra at the rotor.

15. The agitating ball mill according to claim 13, wherein the hollow rotor exhibits liner channels, which each form a flow channel between said at least one radially inner hole and said at least one radially outer hole.

16. An agitating ball mill, comprising:

a grinding chamber containing grinding media;

a stator and a rotor which are arranged in the grinding chamber, said rotor being shaped as a rotationally symmetrical element and said stator being formed by an inner surface of the grinding chamber, said inner surface presenting a shape which essentially compliments the rotor surface, the rotor and the stator each having pins arranged over an entire respective surface thereof which extend from the respective surface and project into the processing space;

structure defining a grinding material input opening and a grinding material output opening for feeding and removing grinding material to or from the grinding chamber, the grinding material input opening being arranged in a radially outer area of the grinding chamber, and the grinding material output opening being arranged in a radially inner area of the grinding chamber; and a grinding medium separation device, arranged in the grinding chamber upstream from the output opening, used to separate grinding media entrained in the grinding material from the grinding material before the grinding material is removed from the grinding space through the output opening, the separation device including a self-cleaning grading screen, said separation device further including a screen jacket within which said grading screen is concentrically arranged, screen cleaning pins being arranged on the rotor and extending into an annular gap defined between the grading screen and the screen jacket.

17. An agitating ball mill, comprising:

a grinding chamber containing grinding media;

a stator and a rotor which are arranged in the grinding chamber, said rotor being shaped as a rotationally symmetrical element, and said stator being formed by an inner surface of the grinding chamber, said inner surface presenting a shape which essentially compliments the rotor surface, the rotor and the stator each having pins arranged over an entire respective surface thereof which extend from the respective surface and project into the processing space;

structure defining a grinding material input opening and a grinding material output opening for feeding and removing grinding material to or from the grinding chamber, the grinding material input opening being arranged in a radially outer peripheral area of the grinding chamber, and the grinding material output opening being arranged in a radially inner area of the grinding chamber; and a grinding medium separation device, arranged in the grinding chamber upstream from the output opening, used to separate grinding media entrained in the grinding material from the grinding material before the grinding material is removed from the grinding space through the output opening, the separation device including a paddle wheel.

18. An agitating ball mill, comprising:

a grinding chamber containing grinding media;

a stator and a rotor which are arranged in the grinding chamber, said rotor being shaped as a rotationally symmetrical element, and said stator being formed by an inner surface of the grinding chamber, said inner surface presenting a shape which essentially compliments the rotor surface, the rotor and the stator each having pins arranged over an entire respective surface thereof which extend from the respective surface and project into the processing space, the rotor being a hollow rotor with at least one hole arranged radially inside the rotor and at least one hole arranged radially outside the rotor, wherein, during operation, the grinding media are transported along with a portion of the grinding material flow inside the rotor from the at least one radially inner hole to the at least one radially outer hole via centrifugal action of the rotor, and transported outside the rotor with an entire grinding material flow from the at least one radially outer hole to the at least one radially inner hole via pumping action of the grinding material input opening, so that the auxiliary grinding media circulate inside the agitating ball mill;

structure defining a grinding material input opening and a grinding material output opening for feeding and removing grinding material to or from the grinding chamber; and a grinding medium separation device, arranged in the grinding chamber upstream from the output opening, used to separate grinding media entrained in the grinding material from the grinding material before the grinding material is removed from the grinding space through the output opening.

* * * * *